US006725507B2

(12) United States Patent
Reynard

(10) Patent No.: US 6,725,507 B2
(45) Date of Patent: Apr. 27, 2004

(54) INTERCONNECTOR FOR FREIGHT CONTAINERS

(76) Inventor: Kenneth Reynard, Unit 7, Carlton Minlott Business Park, Thirsk (GB), YO7 4NF ( * ) Notice: Subject to any disclaimer, the term of this patent is extended or adjusted under 35 U.S.C. 154(b) by 20 days.

(21) Appl. No.: 10/233,896

(22) Filed: Sep. 3, 2002

(65) Prior Publication Data

US 2003/0006233 A1 Jan. 9, 2003

Related U.S. Application Data

(63) Continuation-in-part of application No. 29/116,533, filed on Jan. 4, 2000, now Pat. No. Des. 465,407.

(51) Int. Cl.[7] ..... B65D 90/00
(52) U.S. Cl. ..... 24/287; 410/82; 220/23.4
(58) Field of Search ..... 220/23.4; 24/287; 410/82

(56) References Cited

U.S. PATENT DOCUMENTS

| | | | | | |
|---|---|---|---|---|---|
| 3,261,070 | A | | 7/1966 | Abolins | |
| 3,726,550 | A | | 4/1973 | Johnson et al. | |
| 4,196,673 | A | * | 4/1980 | Looks | 410/89 |
| 4,782,561 | A | * | 11/1988 | Hayama | 24/287 |
| D305,219 | S | | 12/1989 | Wood | D8/382 X |
| 5,193,253 | A | * | 3/1993 | Janke et al. | 24/287 |
| 5,676,271 | A | * | 10/1997 | Reynard | 220/1.5 |
| D399,008 | S | | 9/1998 | Thomas | D8/382 X |
| 6,336,765 | B1 | * | 1/2002 | Watanabe | 403/325 |
| D465,407 | S | | 11/2002 | Reynard | D8/382 |

FOREIGN PATENT DOCUMENTS

| | | |
|---|---|---|
| DE | 19835405 | 2/2000 |

* cited by examiner

*Primary Examiner*—Joseph Man-Fu Moy
(74) *Attorney, Agent, or Firm*—Madson & Metcalf

(57) ABSTRACT

An interconnector is disclosed for joining an adjacent pair of freight containers together with corner fittings. Each corner fitting has an outer face provided with an entry aperture which has a pair of opposed parallel, or substantially parallel edges on opposite sides of a longitudinal axis of the aperture. The interconnector has a rotatable actuator shaft, an actuator stem projecting outwardly of the shaft, a pair of clamping heads provided one on each end of the shaft, and a two part housing in which the actuator shaft is rotatably mounted. Each head has a pair of opposed substantially parallel sides that allow the head, when properly aligned, to pass through an entry aperture. The housing has a central barrel, shear blocks projecting axially outwardly of opposed ends of the barrel, and a pair of abutment surfaces.

5 Claims, 5 Drawing Sheets

INTERCONNECTOR FOR FREIGHT CONTAINERS

This application is a continuation-in-part of application Ser. No. 29/116,533, filed Jan. 4, 2000, and entitled INTERCONNECTOR FOR JOINING TOGETHER FREIGHT CONTAINERS END TO END which application is incorporated herein by reference. now U.S. Pat. No. D465,407

This invention relates to an interconnector for joining adjacent freight containers together.

Freight containers are rectangular box-like structures and usually have heavy duty corner fittings (rectangular in cross section) welded in position at each of the eight corners of the structure. To allow adjacent containers to be coupled together (horizontally and/or vertically), the corner fittings are provided with elongated apertures which are parallel sided (or nearly so), and which have curved ends, and through such apertures can be taken the clamping heads of fixing devices which are used to join two containers together.

The corner fittings usually have one large aperture in a top or bottom face of the fitting (depending upon whether the fitting is in the top or bottom side of the container), and two smaller apertures on two adjacent sides of the fitting. The large aperture is used to allow two containers to be stacked on above the other, and clamping for fixing devices (usually known as "stackers") are taken through the bottom aperture of the uppermost corner fitting and the top aperture of the lowermost corner fitting (of an overlying pair of corner fittings), and then the devices are tightened in order to clamp together a pair of overlying corner fittings together in a rigid and shake-proof manner.

Horizontally adjacent containers can be clamped together using clamping devices (usually known as interconnectors), taken through the facing apertures of two adjacent corner fittings. Containers, e.g. mini containers, can be clamped together to form an ISO standard assembled container module, and while the connection needs to be robustly constructed (to withstand shear, bending, compression and tensile loads to which it may be subjected in service), a certain amount of "play" in the engagement between each interconnector and the two corner fittings can be tolerated.

However, despite this permitted tolerance, there can in practice be handling/operating problems as a result of small misalignments in the initial securement of the corner fittings on the corners of each outer wall of the container. Thus, the corner fittings are welded in position at the junction between each horizontal and vertical outer frame component or "rail", and it is necessary, as far as possible, to ensure that each outer face of a fitting is parallel, or substantially so, to the outer wall of the container which it is adjacent to.

It is important therefore to maintain the faces substantially parallel, because any appreciable deviation makes it difficult to pass the clamping heads (of the interconnector) through the apertures, and especially makes it difficult to rotate the heads to, or from the clamping position (clamping heads usually are rotated through approximately 90° to clamp or unclamp the fitting).

Therefore, official design tolerances are set for assembly of corner fittings according to ISO standard 1161, and which equates, in rough terms, to tolerances of ±1° relative to strict parallel set-ups. However, even the setting of such an exacting standard (bearing in mind the environment in which welding of a corner fitting will take place), can cause operating problems in clamping/unclamping with use of existing designs of interconnector.

One known type of interconnector will now be described with reference to FIGS. 1 and 2 of the accompanying drawings.

Referring to FIG. 1, this shows in perspective illustration an assembly of four mini containers, clamped together side by side to form a standard 20 foot ISO module. The assembled module therefore comprises a 20 foot ISO shipping container which can easily be handled by all conventional equipment.

To allow the coupled together assembly of mini containers to be handled satisfactorily as a 20 foot composite module, it is desirable to minimise the sag of the coupled unit. To achieve this, the clearance at each connector is normally kept to less than 1 mm.

FIG. 2 shows the typical standard interconnector attached to a corner fitting which is misaligned up to the maximum "out of square" setting which is permitted under the ISO standard 1161. This gives rise to taking-up all of the clearance built into the system, and makes it very difficult to lock and unlock the assembly, as will be discussed in more detail below.

Figure 1:
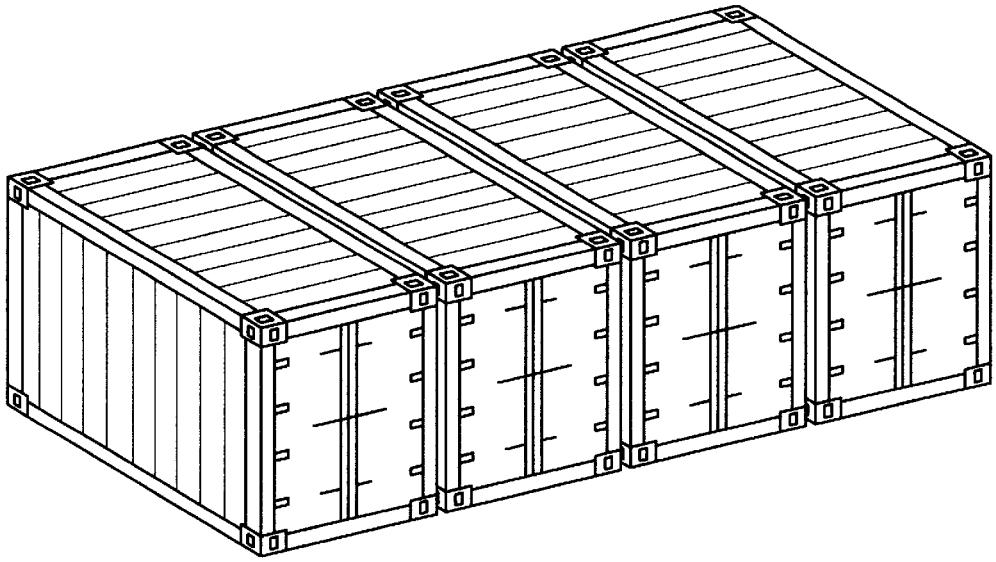
Figure 2A:
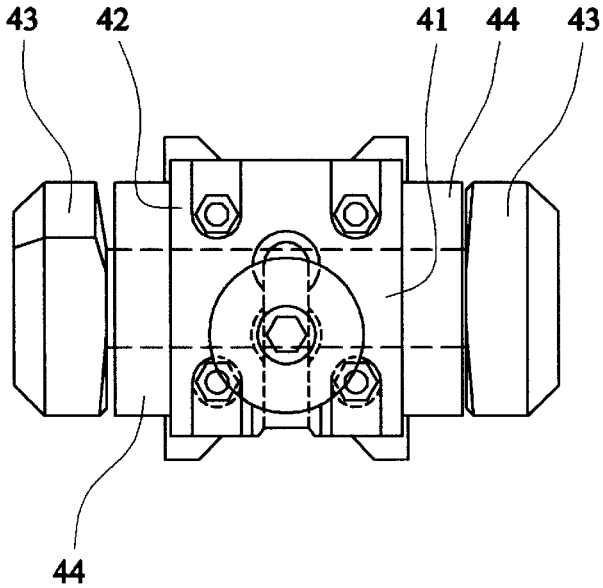
FIGS. 2*a* and 2*b* are plan and end elevation views of the standard interconnector, with FIG. 2*a* showing the interconnector in an intermediate position of adjustment of the clamping heads, in plan view, and FIG. 2*b* showing this in end view.
Figure 2B:
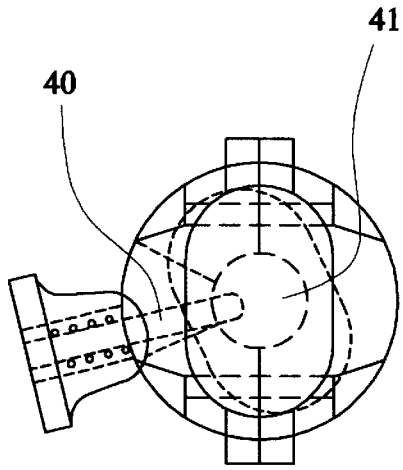

FIG. 2*a* is a plan view of the interconnector, and FIG. 2*b* is an end view, and this shows an actuator stem 40 projecting radially outwardly of actuator shaft 41, which is housed within a two part housing 42, having two housing parts clamped together by bolts, as shown. At each end of the actuator shaft 41 there is a respective clamping head 43, and adjacent to each clamping head 43 is a respective shear block 44.

To couple the interconnector with a corner fitting, the actuator shaft must be manipulated so that one of the clamping heads 43 and the adjacent shear block 44 have their opposed sides parallel to each other, and parallel also to the vertical side edges of the side entrance aperture in the corner fitting. This adjusted assembly of clamping head and shear block then can enter the entrance aperture, and the clamping head 43 is then located internally of the corner fitting. This will correspond to load position 1. The actuator stem 40 then moves from load position 1 to load position 2 as shown, which rotates the clamping head 43 already located within the corner fitting, and at the same time rotates the opposite clamping head 43 so that it is in alignment with its shear block 44, so that this adjusted assembly can then be presented to the corner fitting of an adjacent container, and with the clamping head then entering the corner fitting. Further rotation of the actuator stem 40 to the locked position shown in FIG. 2*b*, then results in both clamping heads 43 being fully clamped within their respective corner fittings.

Figure 2:
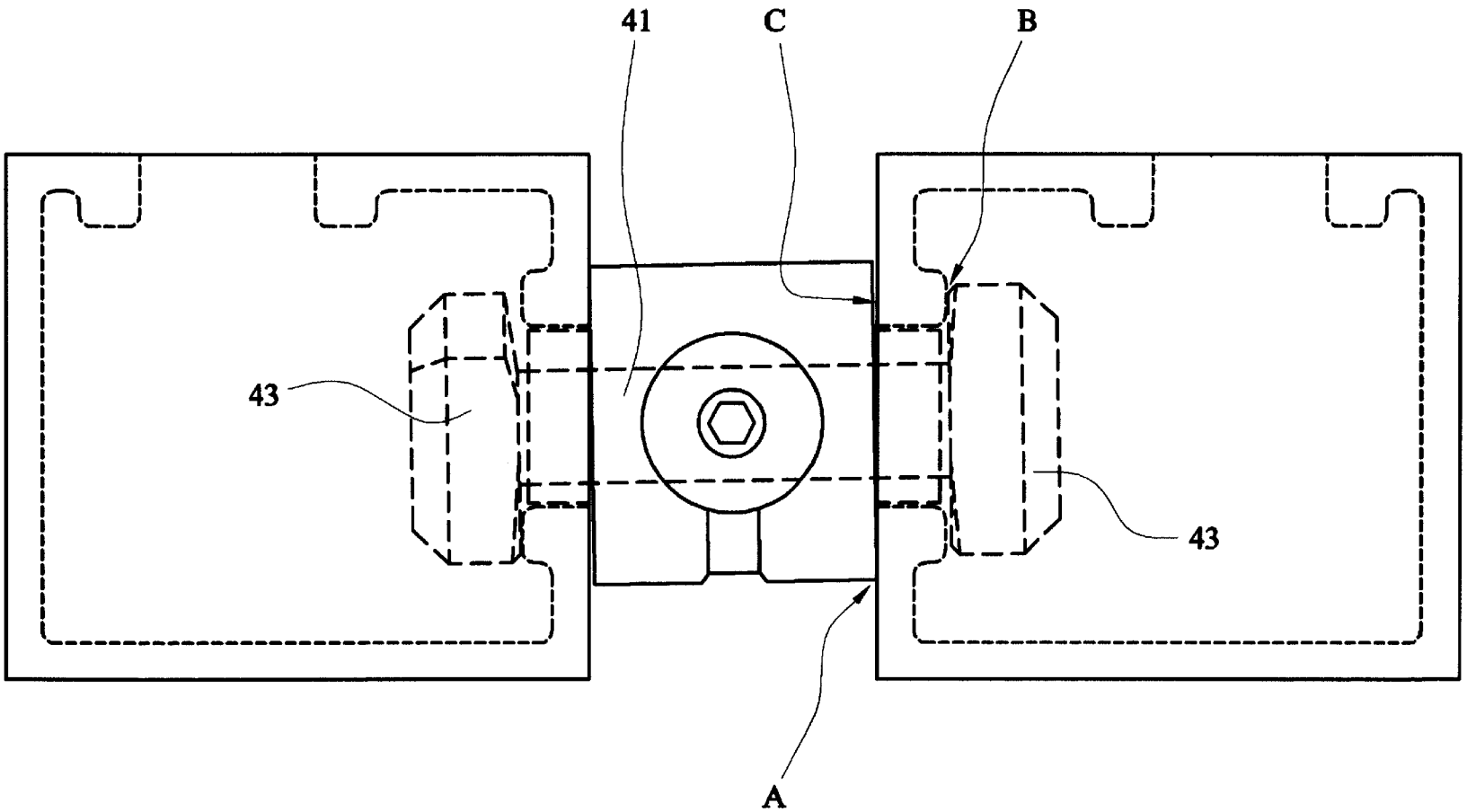
FIG. 2 is a plan view of a typical standard design of interconnector, joining together two facing corner fittings of two adjacent containers.

Referring now to FIG. 2 again, this shows the housing 42 located between the two corner fittings, and making contact, substantially without clearance, with the outer faces of the corner fittings. However, in the case of permitted design tolerance under ISO standard 1161, there will be contact point A along the right hand side of the housing, with the right hand corner fitting, and with a clearance shown by reference C. However, on the left hand side of the housing, there remains substantially continuous contact with the left hand corner fitting i.e. there is no clearance. There is also corresponding internal contact between clamping head 43 and the right hand corner fitting, as shown at contact point B. This is an indication of what will arise when a corner fitting has been assembled according to ISO standard 1161, and being 1.5 mm "out of square". In such even, rotation of the right hand clamping head to and from the clamping position involves substantial frictional contact, and makes it a difficult operation.

As will be described with reference to the preferred embodiments, design provision is deliberately made to set a clearance between the right hand and left hand sides of the housing, and the facing sides of the adjacent corner fittings.

According to the invention there is provided an interconnector for joining an adjacent pair of freight containers together in side by side, or end to end manner with corner fittings on the two containers facing each other in pairs to be coupled togther via a respective interconnector, each corner fitting having an outer face provided with an entry aperture which has a pair of opposed parallel, or substantially parallel edges on opposite sides of a longitudinal axis of the aperture, in which the interconnector comprises:

a rotatable actuator shaft;

an actuator stem projecting outwardly of the shaft;

a pair of clamping heads provided one on each end of the shaft, each head having a pair of opposed substantially parallel sides allowing the head to pass through a respective entry aperture when the head is angularly aligned with its sides substantially parallel to the edges of the aperture;

a two part housing in which the actuator shaft is rotatably mounted, said housing parts being clamped together in order to mount the actuator shaft therein;

in which the housing comprises:

a central barrel having a circumferentially extending slot through which the actuator stem extends, said stem being movable lengthwise of the slot in order to rotate the shaft between clamping and unclamping modes;

shear blocks projecting axially outwardly of opposed ends of the barrel and each having opposed parallel sides which are aligned with the respective clamping head when the head and the shear block are presented to the entrance aperture of one of the corner fittings, so that the clamping head can be received internally of the fitting and the shear block can be located substantially within the operative, and each shear block having a longitudinal axis extending parallel to the shear block sides; and, a pair of abutment surfaces provided on each axially outer end of the barrel and/or the respective shear block, and which are diametrically opposed along an axis corresponding to the axis of each shear block, each pair of surfaces being spaced axially outwardly of the respective outer end of the barrel and being engageable with opposed surface regions of the outer face of the respective corner fitting located adjacent the ends of the entrance aperture whereby to define axial clearance between the outer faces of the fittings and the adjacent barrel ends.

Therefore, each pair of abutment surfaces provides limited engagement with the respective face of the corner fitting and through only a small circumferential area of contact, and therefore axial clearance is defined between each barrel end and the adjacent face of the respective corner fitting. This provides tolerance, which can compensate for any permitted misalignment in the initial assembly of a corner fitting on a container e.g. within the ISO standard, and without any adverse effect on the internal clearance between each clamping head located within the corner fitting.

Therefore, clamping and unclamping operations can be carried out without difficulty, even in the event of initial misalignment of the corner fitting.

The abutment surfaces each may have an arcuate area of contact through a few degrees only, provided that the engagement is sufficiently robust to enable shear and other loads to be transmitted from one container to another via the interconnector.

The abutment surfaces may be formed in any suitable manner e.g. may comprise spacer blocks welded or otherwise secured subsequently to the axially outer ends of the barrel, and/or to the outermost ends of each shear block. However, conveniently, each housing part is formed as a single casting (a barrel half, plus two shear block halves), and then partial machining off the shear block halves may form the abutment surfaces.

Figure 3:
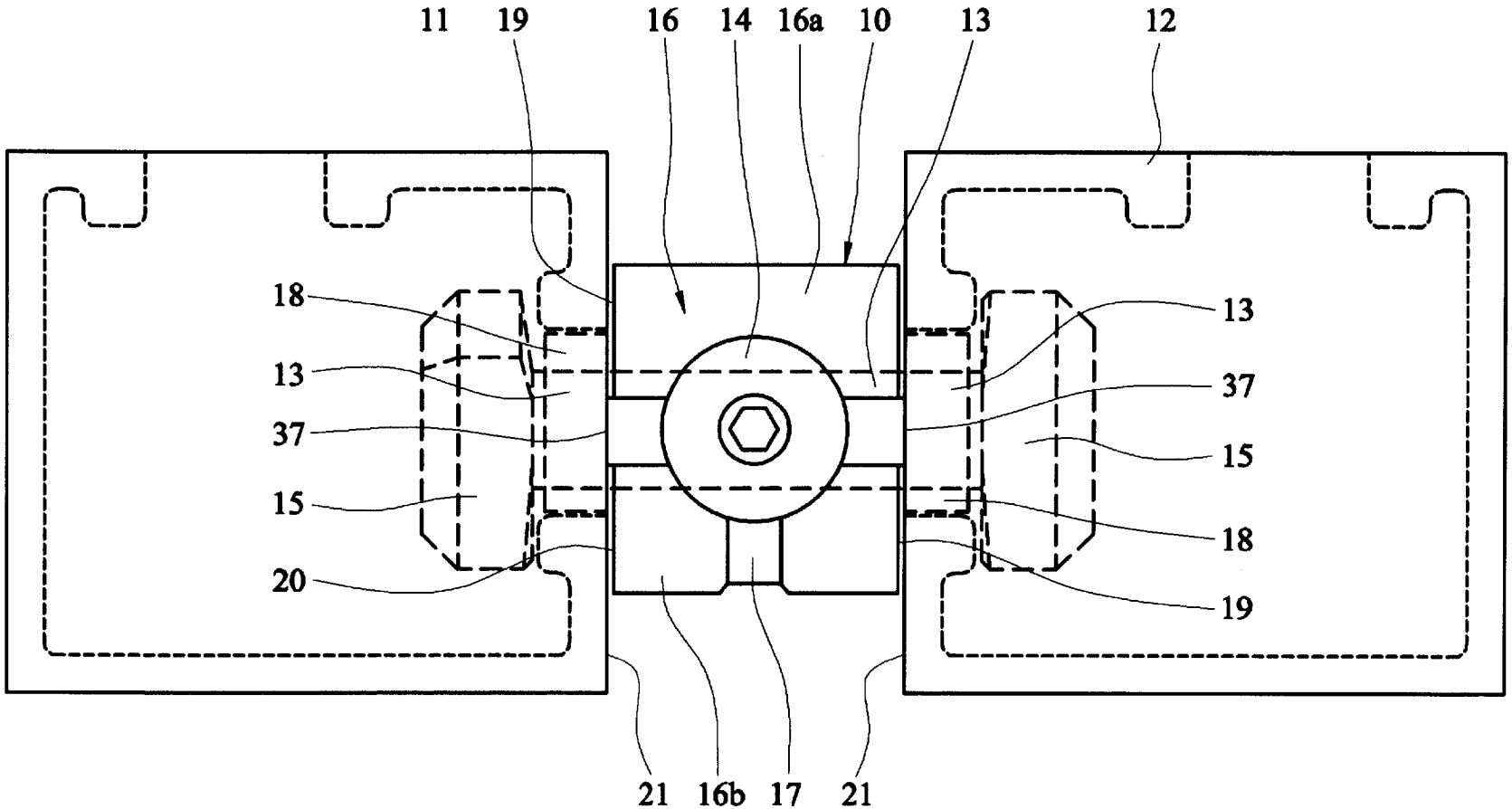
Figure 4:
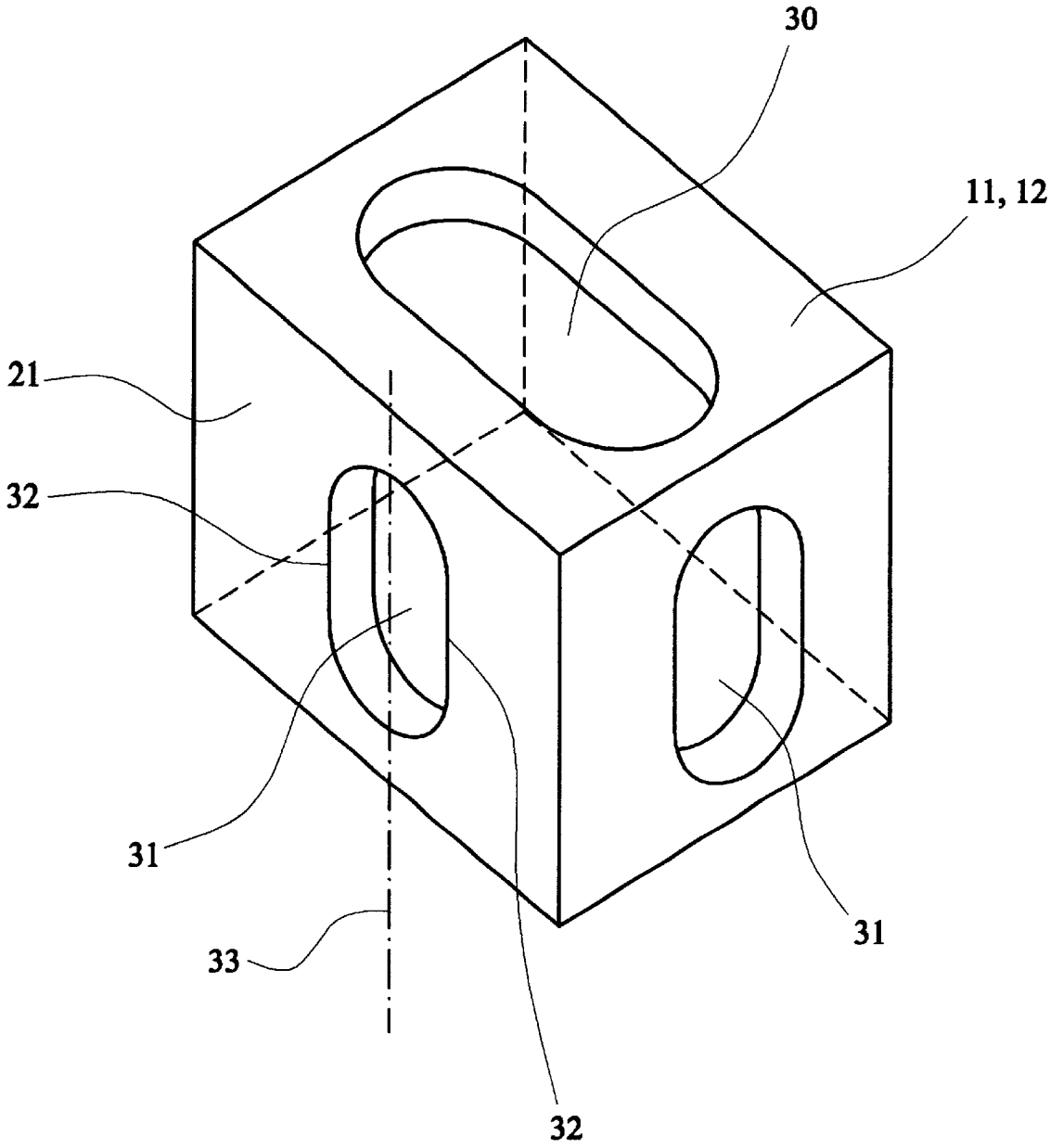
Figure 5:
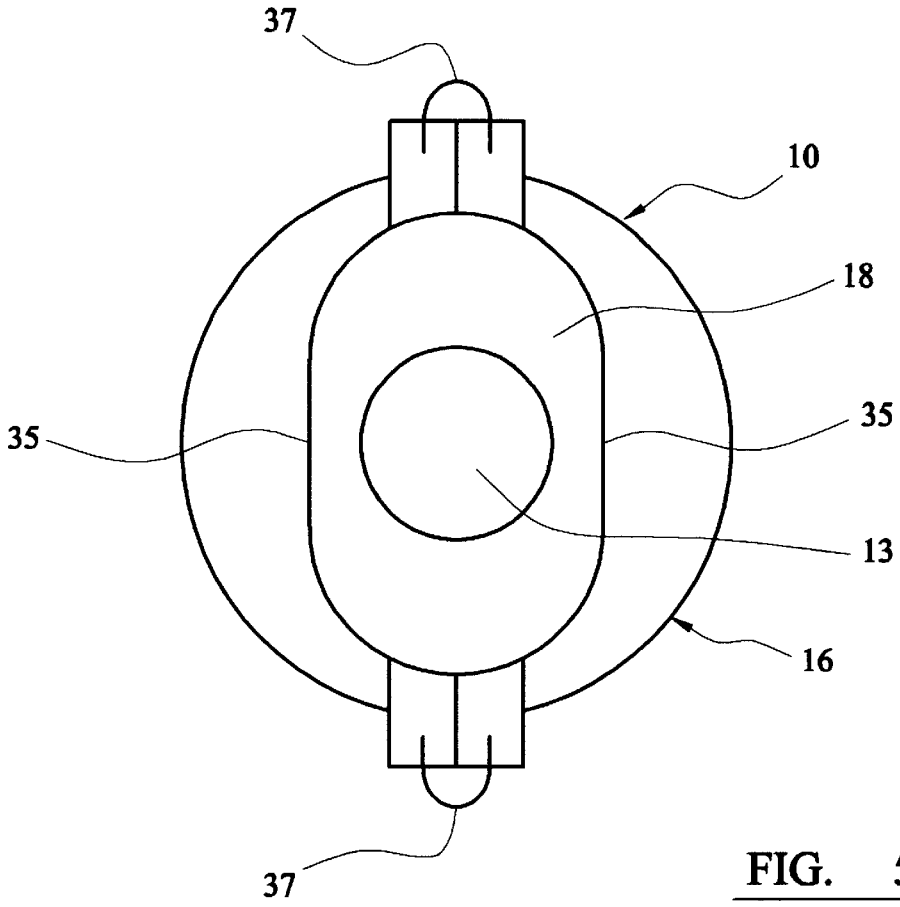
Figure 6:
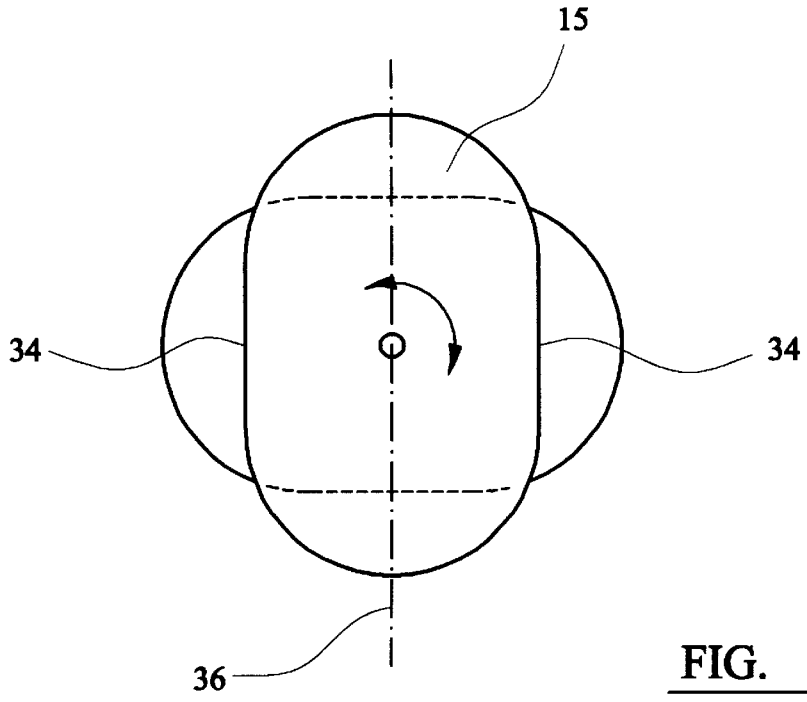

A preferred embodiment of interconnector according to the invention will now be described in detail, by way of example only, with reference to FIGS. 3 to 6 of the accompanying drawings in which:

FIG. 3 is a plan view of the interconnector in situ, clamping together a pair of adjacent corner fittings of two containers arranged side by side, or end to end to be coupled together and form a composite container module;

FIG. 4 is a perspective illustration of a corner fitting for receiving a clamping head of the interconnector shown in FIG. 3;

FIG. 5 is an end view of the interconnector, with the clamping head removed for clarity; and, FIG. 6 is an end view of a clamping head.

Referring now to FIG. 3 of the drawings, an interconnector according to the invention is designated generally by reference 10, and the main parts of its construction and mode of operation are generally similar to the known design of interconnector described above with reference to FIGS. 2, 2*a* and 2*b*. The interconnector 10 is shown in situ, clamping together a corner fitting 11 welded in position at one of the corners of one freight container, and a corner fitting 12 welded in position on another container, two such containers being located side by side when they are required to be clamped together to form an ISO standard module. Typically, the freight containers can be mini containers.

As is well known (see FIG. 4), standard designs of corner fitting usually have an enlarged entrance slot 30 provided in an upper or lower face thereof (to allow containers to be stacked one above the other), and also a pair of smaller side entry apertures 31. The present invention is primarily concerned with an interconnector for joining adjacent freight containers in side by side manner.

Therefore, each corner fitting has an outer face 21 provided with an entry aperture 31 which has a pair of opposed parallel or substantially parallel edges 32, on opposite sides of a longitudinal axis 33 of the aperture.

The interconnector 10 comprises a rotatable actuator shaft 13 and which has an actuator stem which projects radially outwardly of the shaft 13, and provided with an actuator knob 14 at its outer end, which allows the stem to move through an arc of movement, whereby to rotate the actuator shaft 13 between clamping and unclamping modes.

A pair of clamping heads 15 is provided (see also FIG. 6) one on each end of the shaft 13, each head having a pair of opposed substantially parallel sides 34 allowing the head 15 to pass through a respective entry aperture 31 when the head is angularly aligned with its sides 34 substantially parallel to the edges 32 of the aperture 31.

A two part housing 16 is provided in which the actuator shaft 13 is rotatably mounted, the two housing parts (designated 16*a* and 16*b*) being clamped together in order to mount the actuator shaft 13 therein.

The housing 16, (formed by clamping together the housing parts 16*a*, 16*b*), comprises a central barrel having a circumferentially extending slot 17 (provided in housing part 16*b*) through which the actuator stem extends, and which defines an arc of movement allowing the shaft 13 to rotate between three different positions (LOAD 1, LOAD 2 and LOCKED).

The clamping heads 15 are circumferentially off-set relative to each other through a small angle, typically about 30°, and in a first "loading" position of the actuator stem one of the heads has its opposed sides 34 aligned with a respective shear block (described below with reference to FIG. 5), so that the clamping head and the adjacent shear block can be presented to the side entrance aperture 31 of one of the corner fittings. The actuator stem is then rotated to a second "loading" position, whereby the first clamping head moves to an initial light holding position within its corner fitting, and the other clamping head then is adjusted so that its sides are in alignment with the sides of its shear block, and which allows this opposite pair of shear block and clamping head to be presented to the corner fitting of the adjacent container. Once this further head and shear block have been received within the respective corner fitting, the actuator stem is then rotated through approximately 90° to a fully clamped position, in which the two clamping heads then both move to fully engaged clamping positions within their respective corner fittings 11, 12.

The shear blocks will now be described in more detail, and are designated by reference 18 in FIG. 3. FIG. 5 also shows the interconnector 10 in end view with a clamping head removed to show the outer profile of the shear block 18. Each shear block 18 projects axially outwardly of the adjacent one of the opposed ends 19 of the barrel 16 and each shear block 18 has opposed parallel sides 35 which are aligned with the respective clamping head when the head and the shear block are presented to the entrance aperture of one of the corner fittings. This enables the clamping head to be received internally of the fitting and the shear block corresponding thereto to be located within the entrance aperture.

Each shear block 18 therefore is parallel sided, and having an external shape generally corresponding with the shape of the corresponding clamping head 15, so that together they present a substantially continuous surface which can enter the respective entrance slot, when the clamping head is adjusted to the entry position. Each shear block 18 therefore has a longitudinal axis of symmetry 36, extending parallel to the sides 34 thereof.

As can be seen in FIG. 3, the opposed ends 19 of the barrel 16 define a small clearance gap 20 between the outer face 21 of each corner fitting 11, 12, and the adjacent outer end 19 of barrel 16. This clearance will be substantially uniform, when the corner fittings 11 and 12 have been exactly welded in position, whereby the outer faces 21 will be exactly parallel to each other, when two adjacent containers are located side by side ready for being coupled together. However, in practice, ISO standard 1161 allows corner fittings to be slightly misaligned, and the main purpose of the new interconnector described herein with reference to FIG. 3 is to compensate for such misalignment, and still allow internal clearance between each clamping head 15 and the interior of the respective corner fitting, allowing unhindered rotation of each clamping head between the clamping and unclamping positions. This is achieved by a new construction which will now be described below.

A pair of abutment surfaces 37 is provided on each axially outer end 19 of the barrel 16 and/or on the adjacent shear block 18, and such abutment surfaces are diametrically opposed along an axis corresponding to the axis 36 of each shear block 18. Each pair of surfaces 37 is spaced axially outwardly of the respective outer end 19 of the barrel 16 and is engageable with opposed surface regions of the outer face 21 of the respective corner fitting located adjacent to the ends of the entrance aperture, whereby to define the axial clearance 20 between the outer faces 21 of the fittings 11, 12 and the adjacent barrel ends 19.

Each pair of abutment surfaces 37 provides limited engagement with the respective outer face 21 of the corner fitting 11, 12 through only a small circumferential area of contact, and therefore axial clearance is defined between the barrel end 19 and the outer faces 21 of the corner fittings. This provides tolerance, which can compensate for any permitted misalignment in the initial assembly of a corner fitting on a container, e.g. within the ISO standard, and without any adverse effect on the internal clearance between each clamping head located within the corner fitting.

The abutment surfaces may have an arcuate area of contact subtending an angle of a few degrees only, provided that the interengagement is sufficiently robust to enable shear and other loads to be transmitted from one container to another via the interconnector.

The abutment surfaces may be formed in any suitable manner e.g. may comprise spacer blocks welded or otherwise secured subsequently to the axially outer ends 19 of the barrel, or to the outer ends of the shear block 18. However, conveniently, each housing part 16*a*, 16*b* is formed as a single forging or casting (forming a barrel half, plus two shear block halves), and then partial machining of the shear block halves may then define the abutment surfaces 37.

What is claimed is:

1. An interconnector for joining an adjacent pair of freight containers together in side by side, or end to end manner with corner fittings on the two containers facing each other in pairs to be coupled together via a respective interconnector, each corner fitting having an outer face provided with an entry aperture which has a pair of opposed parallel, or substantially parallel edges on opposite sides of a longitudinal axis of the aperture, in which the interconnector comprises:

a rotatable actuator shaft;

an actuator stem projecting outwardly of the shaft;

a pair of clamping heads provided one on each end of the shaft, each head having a pair of opposed substantially parallel sides allowing the head to pass through a respective entry aperture when the head is angularly aligned with its sides substantially parallel to the edges of the aperture;

a two part housing in which the actuator shaft is rotatably mounted, said housing parts being clamped together in order to mount the actuator shaft therein;

in which the housing comprises;

a central barrel having a circumferentially extending slot through which the actuator stem extends, said stem being movable lengthwise of the slot in order to rotate the shaft between clamping and unclamping modes;

shear blocks projecting axially outwardly of opposed ends of the barrel and each having opposed parallel sides which are aligned with the respective clamping head when the head and the shear block are presented to the entrance aperture of one of the corner fittings, so that the clamping head can be received internally of the fitting and the shear block can be located substantially within the aperture and each shear block having a longitudinal axis extending parallel to the shear block sides; and a pair of abutment surfaces provided on each axially outer end of the barrel and/or the respective shear block, and which are diametrically opposed along an axis corresponding to the axis of each shear block, each pair or surfaces being spaced axially outwardly of the respective outer end of the barrel and being engageable with opposed surface regions of the outer face of the respective corner fitting located adjacent the ends of the entrance aperture whereby to define axial clearance between the outer faces of the fittings and the adjacent barrel ends.

2. An interconnector according to claim 1, in which the two separate parts of the housing are forgings or castings, each part forming half of the barrel, and half of the shear blocks.

3. An interconnector according to claim 2, in which the abutment surfaces are machined from the halves of the barrel.

4. An interconnector according to claim 2, in which the abutment surfaces are formed on the halves of the shear blocks.

5. An interconnector according to claim 1, in which the abutment surfaces are formed by spacer blocks.

* * * * *